United States Patent [19]

Maier et al.

[11] Patent Number: 4,729,194

[45] Date of Patent: Mar. 8, 1988

[54] BALANCED ORBITAL SANDER/GRINDER

[75] Inventors: Peter Maier, Neidlingen; Horst Haberhauer, Plochingen, both of Fed. Rep. of Germany

[73] Assignee: Festo KG, Esslingen, Fed. Rep. of Germany

[21] Appl. No.: 862,779

[22] Filed: May 13, 1986

[30] Foreign Application Priority Data

May 25, 1985 [DE] Fed. Rep. of Germany ..... 3518984

[51] Int. Cl.[4] ..... B24B 23/04

[52] U.S. Cl. ..... 51/170 MT; 74/87

[58] Field of Search ..... 51/170 MT; 74/574, 87

[56] References Cited

U.S. PATENT DOCUMENTS

| | | | |
|---|---|---|---|
| 2,220,309 | 1/1942 | Kehle | 51/170 MT |
| 2,367,668 | 1/1945 | Champayne | 51/170 MT |
| 2,918,761 | 12/1959 | Earl | 51/170 MT |
| 3,608,388 | 9/1971 | Huber | 74/87 |
| 3,722,381 | 3/1973 | Tuneblom | 74/87 |
| 4,145,936 | 3/1979 | Vincent | 74/574 |

*Primary Examiner*—Harold D. Whitehead

*Attorney, Agent, or Firm*—Frishauf, Holtz, Goodman & Woodward

[57] ABSTRACT

An orbital sander/grinder has on one side of its housing a rotatably mounted disk holder which is brought into orbital motion by means of a drive mechanism that is inside the housing, and is coupled with an eccenter. The eccenter is rotatably mounted on one side in the housing, on the other side in the disk holder, while the rotational axis in the housing is radially offset relative to the rotational axis of the eccenter in the disk holder, but the two axes run parallel to each other. A balancing weight for compensating the unbalance rotates in synchronization with the eccenter. To ensure sanding/grinding with a minimum of vibration, means are provided to compensate for the transverse forces generated by the abrasive and/or cutting forces that are exerted at the eccenter.

12 Claims, 6 Drawing Figures

BALANCED ORBITAL SANDER/GRINDER

The present invention relates to a sanding or grinding apparatus, and more particularly to a hand-held orbital sander/grinder, for example of the type having a sanding pad to which sanding sheets or grinding sheets can be attached.

BACKGROUND

In such orbital sanders/grinders which are known in practice, the center of gravity of the balancing weight lies on the theoretical connecting line between the two rotational axes of the eccenter er eccentric, i.e. in terms of the rotational axis in the housing diametrical to the rotational axis of the eccenter in the disk holder. Thus when the orbital sander/grinder is raised from the workpiece, practically all forces generated in the disk holder and revolving about the rotational axis of the eccenter in the housing are compensated for in this manner.

At least when the thus balanced sander/grinder is pressed against the surface of the workpiece, cutting forces occur which in terms of the rotational axis of the eccenter generate a torque in the housing and thus generate transverse forces that act upon the eccenter and revolve about the rotational axis of the eccenter in the housing in accordance with the orbital motion of the disk holder. These transverse forces which constantly change direction are translated by the disk holder to the housing or the handle. The transverse forces occurring at the handle are felt by the operator as annoying oscillations.

In addition it may occur—at least in larger orbital sanders/grinders—that the elastic couplings by which the disk holder is fastened to the housing already generate considerable transverse forces when the disk holder is brought into oscillating or orbital motion in relation to the housing. In such cases a balancing weight, whose center of gravity lies in the theoretical continuation of the normal line bisecting the two rotational axes, would result only in inadequate balancing.

THE INVENTION

It is an object to provide an orbital sander/grinder, especially a hand-held orbital sander/grinder, which during operation produces less vibration in the housing and in the handle.

Briefly, transverse forces arising due to the cutting or grinding effect between a sanding or grinding surface of a sanding or grinding disk or sheet, secured to a holder or pad and a workpiece, are balanced by a weight which is so located that, in operation, it exerts forces affecting and acting on the eccenter axis of rotation in a direction at right angles with respect to a theoretical connecting line between the axis of rotation of the sander's drive shaft and the axis of rotation of the eccenter or eccenter weight.

In accordance with a feature of the invention, the balancing weight may be formed by the balancing weight which is already present in the sanding/grinding machine, but changed in position from the location in accordance with the prior art, by shifting the center of gravity of the balancing weight so that, in operation, it will provide the transverse force to the eccenter axis, to compensate for the counter force as a result of the cutting or grinding action of the sanding/grinding disk or surface on the workpiece.

Depending on the relationship between the centrifugal forces generated by the disk holder oscillating in an orbital path and the transverse forces generated by the friction of the disk holder in relation to the housing and the cutting forces during operation, it can either be sufficient to arrange the already present balancing weight in a slightly rotated position, or alternatively it might be better to use an additional balancing weight as a means to compensate for the transverse forces. In the first case, the arrangement is such that the connecting line between the rotational axis of the eccenter in the housing and the center of gravity of the balancing weight runs approximately parallel to the sum force vector of the centrifugal force of the disk holder moved along the orbital path and the transverse force acting upon the eccenter. In that case it is assumed that because of the relatively minor transverse forces the sum force vector is only negligibly greater than the centrifugal force vector.

When the cutting forces and the inner friction of the orbital sander/grinder produce greater transverse forces leading to a sum force that is acting upon the eccenter and is greater than the centrifugal force, it is practical to provide a second balancing weight that is coupled to and revolving with the eccenter and whose mass is such that at a certain speed of the eccenter, it generates a force equal to the transverse force acting upon the eccenter. The center of gravity of the second balancing weight lies on a theoretical line through the rotational axis of the eccenter in the housing that runs at right angles to the connecting line of both rotational axes of the eccentre.

To simplify matters it is quite possible to combine the first and second balancing weights into a unitary, if need be one-piece, balancing weight.

However, the thus invariable balance dimensioned for the operational mode means that the balance is not as adequate when the sander/grinder is lifted. Normally this does not present a particular problem, since the raised sander/ grinder does not have to be running. But it is more practical to balance the sander/grinder for idling as well as for the operational mode. This is of particular advantage when the sander/grinder has to be frequently moved during operation without being switched off. In that case it is practical when the distance between the center of gravity of the balancing weight and the normal line bisecting the two rotational axes is automatically adjustable, depending on the cutting force.

In principle there are two solutions to this problem. One way would be to connect the balancing weight rigidly to the eccenter which in turn is rotatably mounted on a drive shaft of the drive mechanism. The rotational axis about which the eccenter is rotatable on the drive shaft lies between the rotational axis that is stationary in the disk holder and the rotational axis that is stationary in the housing and runs parallel to both rotational axes, while the eccenter is rotatably coupled with the drive shaft via an elastic coupling element. With this arrangement the sum force vector composed of cutting force and centrifugal force is rotated and thus becomes parallel to the centrifugal force vector which acts upon the center of gravity of the balancing weight.

Another possibility for automatic adjustment is an arrangement where the balancing weight as well as the eccenter are rotatably mounted on the drive shaft of the drive mechanism whose rotational axis forms the stationary rotational axis of the eccenter in the housing.

Again the drive shaft is rotatably coupled with the output shaft via an elastic coupling element, while inside the eccenter a gear element is mounted which when the eccenter is rotated about the drive shaft, turns the balancing weight about the drive shaft in the same direction, but at a greater angle. This gear element acts in the manner of a planetary gear arranged between the drive shaft and the centrifugal weight, where the eccenter itself represents the sun wheel.

Since with most orbital sanders/grinders the abrasive and cutting forces occurring under load as well as during idling are constant within certain tolerances, it is completely adequate for the eccenter to have a limited rotational angle in relation to the drive shaft, while the elastic force of the elastic coupling element is such that the eccenter is brought into rest position during idling, and while the eccenter flips over into an operational position when a predetermined cutting force is exceeded.

DRAWINGS

DETAILED DESCRIPTION

Figure 1:
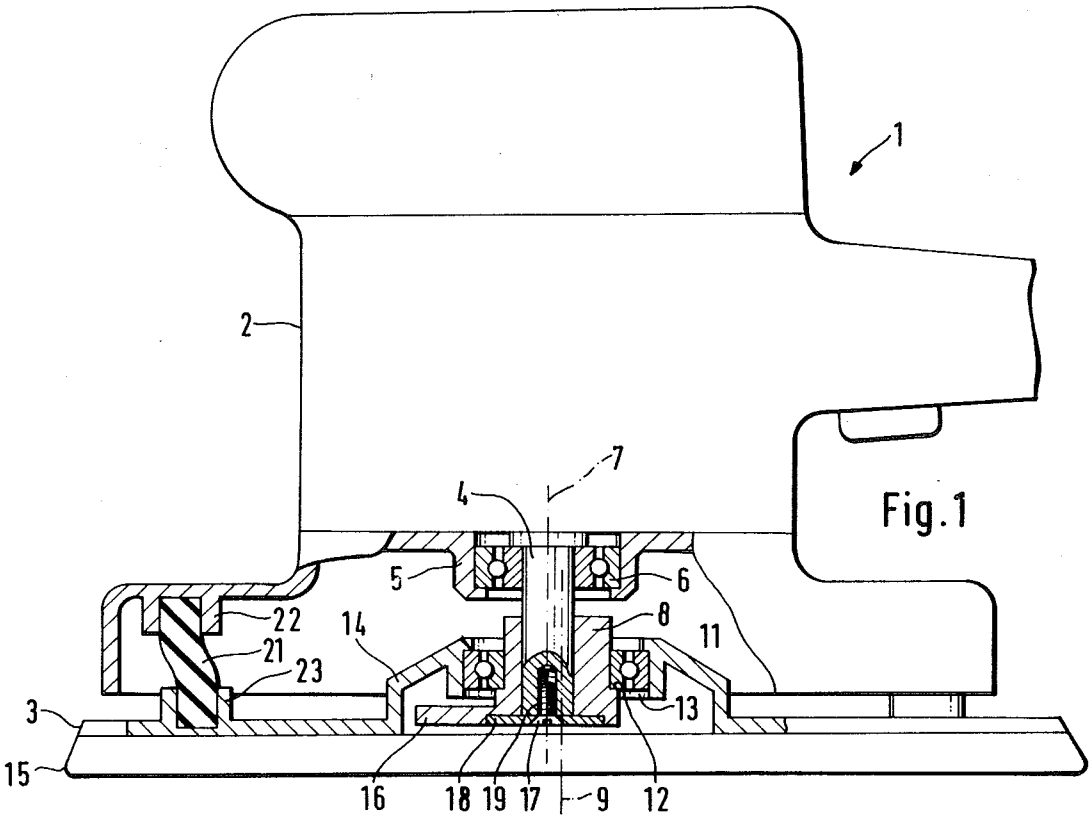
FIG. 1 shows an orbital sander/grinder according to the invention, with a partly exposed housing and a partly exposed disk holder, in a lateral view.

FIG. 1 illustrates an orbital sander/grinder 1 in whose housing 2 is arranged a drive mechanism in the form of an electric or compressed air motor which serves the purpose of bringing a disk holder 3 elastically connected to housing 2 into oscillating motion in relation to housing 2. Housing 2 constitutes the stationary reference point and is meant to remain as motionless as possible. To generate the relative motion, a drive shaft 4 of the drive mechanism is rotatably mounted in a bearing flange 5 of housing 2 via a radially grooved ball bearing 6, to rotate about a rotational axis 7 running at right angles to a plane defined by disk holder 3. The oscillating motion of disk holder 3 is generated by an eccenter 8 that is non-rotatably mounted on the end of drive shaft 4 that protrudes from grooved ball bearing 6 and that has a cylindrical outer peripheral surface whose axis of symmetry 9 is radially offset in relation to rotational axis 7 of drive shaft 4. Eccenter 8 carries another radially grooved ball bearing 11 that is slipped on until it contacts a shoulder 12 of eccenter 8. Thus the axis of symmetry 9 forms the rotational axis of eccenter 8 in disk holder 3, running parallel to rotational axis 7.

The outer ring of grooved ball bearing 11 fits into a bearing hole 13 that is inside the dome-shaped cap 14 of disk holder 3. Dome-shaped cap 14 is a single-piece component of disk holder 3 and arches toward the underside of housing 2. It is situated about midway on the rectangular disk holder 3 on whose underside is glued or otherwise fastened an elastic base plate 15 which constitutes the base pad on which the back side of the sheet of sandpaper lies when it is stretched on. The fastening devices for holding the sandpaper are not shown for the sake of clarity.

To compensate for the balance error caused by disk holder 3 with base plate 15 as well as by eccenter 8 and the cutting forces, a unitary balancing weight 16 has been coupled with eccenter 8; said balancing weight 16 rotates inside the cavity that is defined by dome-shaped cap 14 and by base plate 15.

Eccenter 8 is axially secured on drive shaft 4 by means of a countersunk screw 17 which is threaded into a coaxial threaded hole 19 of drive shaft 4 and has an interspersed washer 18. Washer 18 forms the contact surface for the lower face of eccenter 8 or of balancing weight 16.

To prevent rotation of disk holder 3 about rotational axis 7 when eccenter 8 is activated, and to force it to perform the desired orbital motion, in cylindrical, elongated elastic members or feet 21 are positioned the vicinity of the four corners of disk holder 3. In FIG. 1 only one elongated elastic foot 21 is shown in the exposed part of housing 2. These cylindrical elastic feet 21 in FIG. 1 fit—as elastic foot 21 alone illustrates—with their end sections into cylindrical cups 22 and 23 thereby joining opposite sides of disk holder 3 to housing 2. In this manner the sections of elastic foot 21 fitting into cups 22, 23 run parallel to rotational axis 9 or rotational axis 7. When eccenter 8 is activated, i.e. when—activated by drive shaft 4— it rotates about stationary rotational axis 7 while at the same time rotating about its own rotational axis 9 in grooved ball bearing 11. All points of disk holder 3 perform circular motions with a radius that equals the distance between the two rotational axes 7 and 9.

Figure 2:
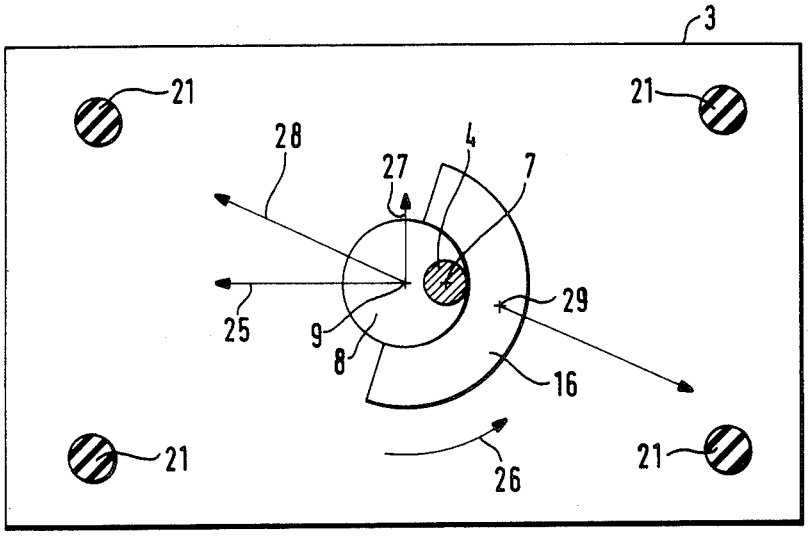
FIG. 2 shows a schematic top view of the disk holder and the eccenter by which it is driven, illustrating the forces acting upon same.

FIG. 2 shows a schematic top view of disk holder 3 and of eccenter 8, clearly showing the forces acting upon eccenter 8; for the sake of clarity all those design details that are unimportant in this connection are omitted.

General Explanation of the Invention

Let it be assumed that eccenter 8 is a one-armed lever whose length equals the distance between the two rotational axes 7 and 9 which run parallel to each other. Let it also be assumed that the entire mass of disk holder 3 is concentrated in the free end of the theoretical one-armed lever, i.e. in the rotational axis 9, and that at that point, too, the abrasive and cutting forces generated by disk holder 3 are exerted. Since eccenter 8 rotates about rotational axis 7—which is as stationary as possible—as a forced rotational axis, the mass of disk holder 3 concentrated in rotational axis 9 rotates about rotational axis 7 with a radius equal to the distance between rotational axes 7 and 9. As a result the mass of the disk holder 3 generates a centrifugal force according to the formula $$F=\omega^2 rm,$$

where $\omega$ is the angular velocity, r is the distance between the two rotational axes 7 and 9, and m is the mass of disk holder 3. This centrifugal force acts upon rotational axis 9 and acts—as indicated by arrow 25—in continuation of the connecting line 25*a* between the two rotational axes 7 and 9, namely in the continuation of the assumed one-armed lever. Thus arrow 25 indicates the centrifugal force vector.

The cutting force that is generated when the orbital sander/grinder 1 is in operation, acts at right angles to the centrifugal force, as do the abrasive forces that are generated between disk holder 3 and housing 2. Assuming the eccenter 8 rotates about rotational axis 7 in counterclockwise fashion—as indicated by arrow 26—, the cutting and abrasive forces act in the direction of arrow 27 which indicates the vector at right angles to vector 25 of the centrifugal force. Both forces together result in a sum force that equals the vectorial addition of both vectors 25 and 27, i.e. of the cutting and abrasive forces on the one hand and the centrifugal force on the other. The resulting sum force is shown in FIG. 2 by sum force vector as indicated by arrow 28.

In state of the art orbital sanders/grinders, only one balancing weight is provided which only serves the purpose of compensating for the centrifugal force generated by disk holder 3.

Therefore in such orbital sanders/grinders the center of gravity of the balancing weight lies on the theoretical connecting line 25*a* of the two rotational axes 7 and 9, i.e. in the continuation of vector 25 of the centrifugal force. The effective mass of balancing weight 16 is such that its centrifugal force compensates for the centrifugal force of disk holder 3. As long as no cutting forces are generated, a reasonably vibration-free operation is achieved, and housing 2 which is held by the operator, remains largely motionless. However, once the sander/-grinder is actually used for sanding or grinding, and once cutting and abrasive forces are generated, state of the art orbital sanders/grinders are no longer vibration-free because the above explained cutting forces act upon eccenter 8, see vector 27. These cutting forces generate associated transverse forces at rotational axis 7 and thus at housing 2 which lead to associated oscillations of housing 2.

According to a feature of the invention of the sander/grinder shown in the figures, balancing weight 16 is therefore arranged in slightly rotated position. The center of gravity 29 of balancing weight 16 of new orbital sander/grinder 1 lies lateral to the connecting line 25*a* which rectangularly bisects the two rotational axes 7 and 9 of eccenter 8 and which lies in a plane containing center of gravity 29. The offset of the center of gravity 29, i.e. the rotation of balancing weight 16 in relation to eccenter 8 or drive shaft 4 is designed in such a way that the centrifugal force acting upon center of gravity 29 of balancing weight 16 acts in a direction that runs parallel to sum force vector 28 and is opposite thereto.

Since in high-speed orbital sanders/grinders with an orbit of small diameter the generated cutting and abrasive forces are smaller by a factor of 10 or more than the centrifugal forces generated by disk holder 3, it is enough when the already present balancing weight is rotated in the above described manner to balance the centrifugal forces. However, if the relationship between the cutting forces and the centrifugal forces shifts in favour of the cutting forces, the above described means may not be adequate, and in that case, in addition to balancing weight 16 whose center of gravity lies on the connecting line between the two rotational axes 7 and 8, another balancing weight is fastened to eccenter 8 or drive shaft 4, and it generates a centrifugal force at the operational speed that equals—according to the cutting and abrasive forces—force vector 27, but acts in the opposite direction and upon rotational axis 7. Of course, both balancing weights can be combined conventionally into a unitary balancing weight which in relation to the balancing weight for compensating the centrifugal force according to force vector 25 has a greater effective mass and a differently positioned center of gravity. In this case, too, the condition is met during operation that the centrifugal force acting upon center of gravity 29 must have the same magnitude as sum force vector 28 to which, however, it acts in an opposite direction.

The orbital sander/grinder constructed in accordance with FIGS. 1 and 2 runs with less vibration during operation or under load than when it is raised off the workpiece and is idling, because in the latter case the centrifugal force vector generated in center of gravity 29 no longer runs parallel to the now exclusively present force vector 25; the cutting forces according to force vector 27 are reduced to 0 during idling. If this behaviour is a problem, it is possible to provide a dynamic adjustment of the position of center of gravity 29 of the balancing weight relative to force vector 25 or sum force vector 28, as shown in the next figures. In those embodiments, the torque translated by drive shaft 4 to disk holder 3 is used to affect the adjustment of the force vectors during operation and idling.

Figure 3:
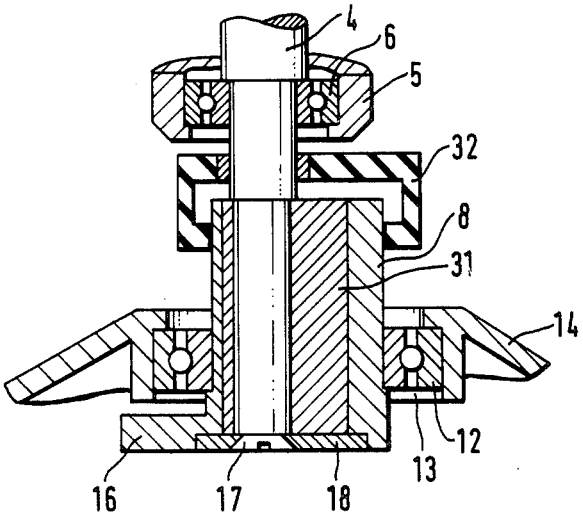
FIG. 3 shows a partial view of the orbital sander/grinder according to FIG. 1 with automatic adjustment of the balancing weight, in a longitudinal section.

FIG. 3 shows a partial view—as required for the description—of the exposed portion of the orbital sander/grinder, as shown in FIG. 1. Those parts that have already been shown in the previous figures are given the same reference numbers Non-rotatably mounted on the end of drive shaft 4 which protrudes from grooved ball bearing 6 is an eccentrically arranged cylindrical shell 31 on which eccenter 8 is rotatably mounted but axially secured. The translation of the torque from drive shaft 4 to eccenter 8 is provided by means of a torsionally elastic coupling element 32 which on the one hand is non-rotatably mounted on drive shaft 4 between grooved ball bearing 6 and the upper face of eccentric shell 31, and which on the other hand is nonrotatably connected with the outer peripheral surface of eccenter 8. Balancing weight 16 again is attached to eccenter 8 as a unitary piece.

Figure 4:
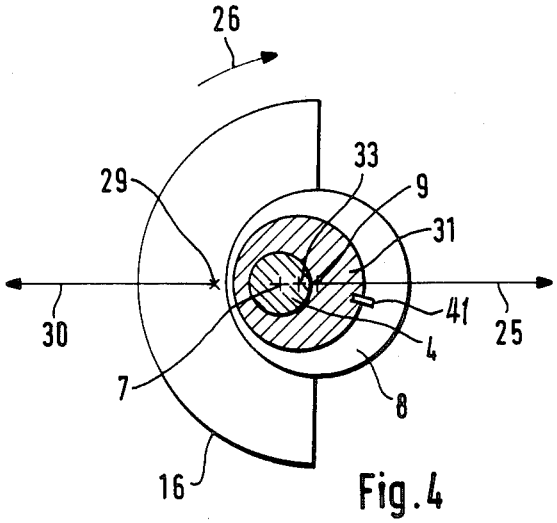
FIGS. 4 and 5 show a schematic top view of the arrangement consisting of the eccenter and the balancing weight according to FIG. 3, illustrating the forces acting upon same in various operational positions.
Figure 5:
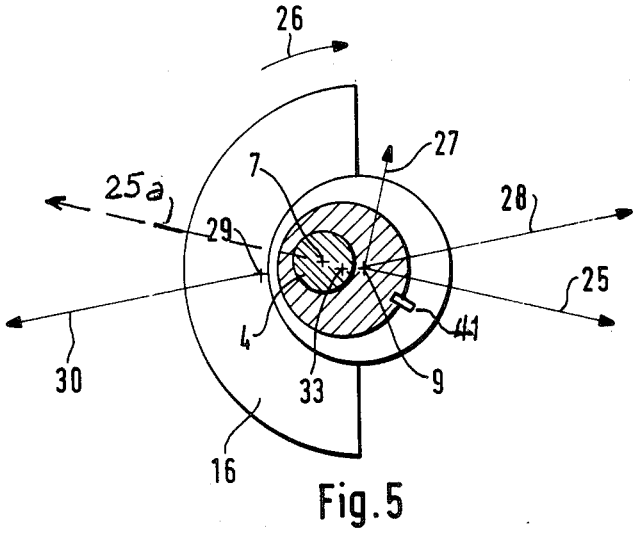

As FIGS. 4 and 5 show, three rotational axes occur in this embodiment; rotational axis 7 and rotational axis 9, which have been described above, and a new rotational axis 33 which runs parallel to rotational axes 7 and 9 and is situated approximately between these, i.e. the rotational axis 33 runs at a distance from rotational axis 7 and also at a distance from rotational axis 9, while both rotational axes 7 and 9, however, are situated on different sides of rotational axis 33.

Regardless of whether the orbital sander/grinder 1 is operating or not, rotational axis 7, which coincides with the axis of drive shaft 4 and is stationary in housing 2, must remain as motionless as possible. Rotational axis 9 describes a circular orbit about rotational axis 7, as described above, so that the distance between the two rotational axes 7 and 9 determined the diameter of the sanding orbit. During idling, when there is practically no abrasion between housing 2 and disk holder 3, two centrifugal forces are generated; the centrifugal force according to force vector 25 caused by the oscillating disk holder 3, and the centrifugal force that is caused by balancing weight 16 which rotates synchronously with eccenter 8 and which is in accordance with a force vector 30 that acts upon center of gravity 29 and runs in continuation of the normal line through center of gravity 29 to rotational axis 7. To ensure that the two vectors 30 and 25 run parallel and opposite to each other, the arrangement in FIG. 3 is mounted in such a way that the elastic coupling element 32 keeps eccenter 8 in a position in which normal line 25*a* through rotational axes 7 and 9 also runs through center of gravity 29.

As soon as a cutting force equal to vector 27 is taken off disk holder 3, a torque is translated via elastic coupling element 32 from drive shaft 4 to eccenter 8. This torque causes a rotation between drive shaft 4 and eccenter 8, namely about rotational axis 33 which is eccentric to drive shaft 4. If the rotational direction is as indicated by arrow 26, drive shaft 4 rotates about rotational axis 33 in the same direction from the idling position shown in FIG. 4 to the operating position shown in FIG. 5.

In mathematical terms, the rotation occurs because at rotational axis 7 a torque occurs that acts in clockwise direction, while sanding force vector 27 at rotational axis 9 causes a counter torque; together these torques cause the rotation of the axes in relation to rotational axis 33. Since force vector 25 which represents the centrifugal force of disk holder 3, always runs in continuation of normal line 25*a* through the two rotational axes 7 and 9, said force vector also performs a clockwise rotational between drive shaft 4 and eccenter 8, which leads to an associated rotation of cutting force vector 27 and the resulting sum force vector 28. Together with the said relative rotation, centrifugal force vector 30 which represents the centrifugal force exerted by balancing weight 16 and acting upon ceneter of gravity 29, also rotates, but in counter-clockwise direction, because this vector 30 runs in continuation of the normal line through center of gravity 29 and rotational axis 7.

Thus by the rotation between eccenter 8 and drive shaft 4, sum force vector 28 and centrifugal force vector 30 are rotated in the plane in such a way relative to rotational axis 7 that they act parallel to each other, but in opposite directions.

It is apparent that the relative rotation between drive shaft 4 and eccenter 8 depends on the intrinsic elasticity of the torsionally elastic coupling element 32 which counteracts the two bending moments acting upon rotational axis 33. By an appropriate adjustment of the intrinsic elasticity of coupling element 32 it can be ensured that sum force vector 28 runs parallel to centrifugal force vector 30, whatever the rate of the cutting force may be.

It is also apparent that the torsionally elastic coupling element 32 turns back eccenter 8 to the starting position as soon as the cutting force is removed, for example when orbital sander/grinder 1 is taken off the workpiece, returning sander/grinder 1 to the position according to FIG. 4.

Since cutting forces occurring in practice do not have a wide range of variation, it is sufficient that eccenter 8 is rotatable on the cylindrical shell 31 only between two terminal positions, one of which represents the idling position as in FIG. 4, the other is adjusted for the operating position as in FIG. 5. For this purpose, the outer peripheral surface of cylindrical shell 31 and the associated receiving hole in eccenter 8 are provided with stops in a conventional manner. The intrinsic elasticity of torsionally elastic coupling element 32 is dimensioned in such a way that on the one hand it ensures the reliable return rotation of the eccenter into the position according to FIG. 4, and that on the other hand the eccenter is not prevented from being turned into the position as in FIG. 5, i.e. into the other terminal position, by a force that is smaller than the smallest cutting force.

Figure 6:
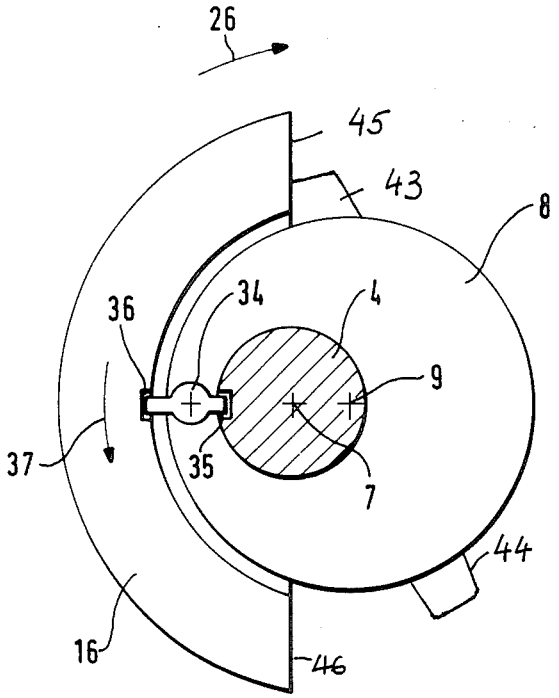
FIG. 6 shows another schematic view of an embodiment according to the invention, illustrating the automatic adjustment of the balancing weight of an orbital sander/ grinder.

Another embodiment for the adjustment of balancing weight 16 depending on the load is shown in simplified form in FIG. 6 which similarly to FIGS. 2, 4 and 5 provides a cross-sectional view at right angles to drive shaft 4.

In the embodiment according to FIG. 6, eccenter 8 is rotatably mounted on output shaft 4 to which it translates the torque via a torsionally elastic coupling element (not shown). Below eccenter 8, balancing weight 16 is also rotatably mounted on drive shaft 4.

Rotatably mounted inside eccenter 8 is a two-armed lever 34 which engages on one side in a recess 35 of drive shaft 4 and on the other side in a recess 36 of balancing weight 16. This two-armed lever 34 acts like the pinion of a planetary gear, while drive shaft 4 represents the sun wheel.

When in this embodiment a torque is translated in the direction of arrow 26 from drive shaft 4 via the torsionally elastic coupling element (not shown) to eccenter 8 which drives disk holder 2, drive shaft 4 in eccenter 8 rotates about its rotational axis 7 according to the torque that is exerted. Drive shaft 4 swings two-armed lever 34 which engages in recess 35 and then turns balancing weight 16 on drive shaft 4 counter to the direction of arrow 26, namely in the direction of arrow 37. When the force diagrams explained in detail for the previous figures are applied to the embodiment according to FIG. 6, it is shown that by swinging the balancing weight 16 during operation, i.e. when cutting forces occur, the centrifugal force vector that is exerted at the center of gravity of balancing weight 16 is turned in the direction parallel to the sum force vector of the centrifugal force of the disk holder and the cutting force. As soon as the cutting force ceases, the torsionally elastic coupling element pulls eccenter 8 back into the shown position, which ensures the best possible balancing during idling as well, as in the embodiment according to FIG. 3.

Both the embodiments according to FIG. 4 and FIG. 6 may comprise a positive limitation of the angle of rotation of the eccenter 8 with respect to the drive shaft 4. To this end, eccenter 8 of the embodiment according to FIGS. 4 and 5 comprises in its upper side face a recess 39 which extends in the circumferential direction of the eccenter 8. The recess 39 accomodates a pin 41, which is inserted in a radially extending bore of eccenter 31. Both side walls of the recess 39 act as abutting surfaces which come into engagement with that portion of the pin 41 which extends radially into the recess 39; i.e. in the non-operating condition that is shown in FIG. 4, the pin 41 abuts one side-wall of the recess 39, whereas in the operating position shown in FIG. 5, the pin 41 abuts the other sidewall of the recess 39, whereby the angle of rotation of the eccenter 39, with respect to the eccenter 8, is positively limited.

According to FIG. 6, the eccenter 8 comprises at its lower end two radially extending protrusions which are diametrically arranged with respect to rotational axis 9 and comprise two abutting surfaces. Facing abutting surfaces 45 and 46 of the balancing weight 16. The relative arrangement of all abutting surfaces is shown in FIG. 6. In the non-operated condition, the protrusion 43 is in engagement with the abutting surface 45, whereas the abutting surface 46 is spaced from the protrusion 44. Under operating conditions, when a substantial torque is applied to eccenter 8 by the resilient coupling element, the eccenter 8 rotates with respect to the axis 4 until the protrusion 44 comes into engagement with the abutting surface 46 and thereby limiting the angle of rotation of the eccenter 8 with respect to the drive shaft 4, since the drive shaft 4 is coupled to the balancing weight 16 by the two-armed lever 34.

We claim:

1. Operationally balanced orbital grinding or sanding machine having a housing (1);

a grinding or sanding disk holder (3) movably retained on the housing adapted to hold a grinding or sanding disk;

a drive shaft (4) rotatably retained in the housing at right angles with respect to the grinding or sanding disk holder and defining a shaft axis of rotation;

an eccentric (8) secured to the shaft (4), said eccentric being rotatable about, and defining, an eccentric axis (9), parallel to and spaced from the shaft axis of rotation, and coupled to said grinding or sanding disk holder;

a balancing weight means (16) rotating in synchronism with the eccentric (8) and having an axis of rotation at least approximately coincident with the shaft axis of rotation to compensate eccentric unbalanced forces relative to the housing generated by the eccentric and the grinding or sanding disk holder (3) coupled thereto upon rotation of the drive shaft (4), wherein, in order to automatically compensate for a transverse rotating force vector (27) arising from the cutting or grinding force effect between a grinding or sanding surface of the grinding or sanding disk secured to the disk holder (3), and a workpiece, said balancing weight means (16) is so positioned with respect to the eccentric axis of rotation (9) and so dimensioned that said weight means, in operation, exerts forces to balance said cutting force vector (27), said weight means acting on the eccentric axis of rotation (9) in a direction at right angles with respect to a theoretical connecting line (25*a*) between the shaft axis of rotation (7) and the eccentric axis of rotation (9) said weight means (16) having a center of gravity (29) being asymmetrically positioned with respect to said theoretical connecting line (25*a*).

2. Machine according to claim 1, wherein the means (16) for balancing transverse forces (27) are formed by the balancing weight (16) in combination with means (32; 34) for positioning the balancing weight in a location in which the center of gravity (29) of the balancing weight (16) is located adjacent, but not on, said theoretical connecting line (25*a*) and spaced from said theoretical line such that the centrifugal force acting at the center of gravity (29) of the balancing weight (16) will have a direction which is at least approximately parallel to a sum force vector (28) formed by the centrifugal force of the disk holder (3) and the cutting force vector (27) acting on the eccentric (8).

3. Machine according to claim 1, wherein the means for balancing the transverse forces comprise a weight means, coupled to the -eccentric (8) and having a mass and position of center of gravity (29) which, upon rotation of the shaft (4) about the shaft axis (7) and at a consequent rotation of the eccentric about the eccentric axis, at a predetermined speed, causes generation of a force which is equal and opposite to the cutting force vector (27) applied against the eccentric.

4. Machine according to claim 1, wherein the transverse force balancing means comprises a weight mass coupled to the eccentric and synchronously rotating therewith, which weight mass has a center of gravity (29) which is spaced from said theoretical line (25*a*) connecting the shaft, the axis of rotation (7) and the eccentric axis (9) by a distance such that, at a predetermined speed of the eccentric (8), a force is generated which is equal and opposite to the transverse force (27) applied to the eccentric.

5. Machine according to claim 3, wherein the weight mass and the balancing weight comprise a unitary element.

6. Machine according to claim 4, wherein the weight mass and the balancing weight comprise a unitary element.

7. Machine according to claim 1, further including means for automatically spacing, in operation, the distance between the center of gravity (29) of the balancing weight (16) from said theoretical connecting line (25*a*) in dependence on the forces arising due to the cutting or grinding effect, to thereby form said transverse cutting force balancing means.

8. Machine according to claim 1, wherein said transverse cutting force balancing means (43-45, 44-46) comprises means for positioning the balancing weight (16) in a location in which the center of gravity (29) of said balancing weight is spaced from said theoretical connecting line (25*a*) by a fixed amount.

9. Machine according to claim 7, wherein the balancing weight (16) is coupled for rotation with the eccentric (8), and the eccentric (8) is rotatably coupled to the drive shaft, for rotation relative to the drive shaft about an orbiting axis (33), and said orbiting axis is positioned between the shaft axis of rotation (7) and the eccentric axis (9), all said axes being parallel to each other;

and an elastic coupling element (32) elastically coupling the eccentric (8) to said drive shaft (4), to thereby permits said relative rotation of said eccentric which respect to the drive shaft and positioning of the center of gravity (29) of the balancing weight (16) at a spacing from said theoretical connecting line (25*a*).

10. Machine according to claim 5, wherein the balancing weight (16) and the eccentric (8) are rotatably coupled to the drive shaft (4);

means (32) for rotation-elastically coupling the drive shaft (4) to the eccentric (8);

and a rotatable, movable coupling element (34) connecting the eccentric (8) and the balancing weight (16) to rotate the balancing weight about the shaft axis of rotation upon rotation of the eccentric by an angle of rotation in excess of the angle of eccentricity of the eccentric.

11. Machine according to claim 9, wherein the angle of rotation of the eccentric (8) with respect to the drive shaft (44) is limited.

12. Machine according to claim 10, wherein the angle of rotation of the eccentric (8) with respect to the drive shaft (44) is limited.

* * * * *